3/19/85 OR 4,505,155

United States Patent [19]

Jackson

[11] Patent Number: 4,505,155

[45] Date of Patent: Mar. 19, 1985

[54] BOREHOLE PRESSURE MEASURING SYSTEM

[75] Inventor: Joshua M. Jackson, Houston, Tex.

[73] Assignee: Sperry-Sun, Inc., Sugarland, Tex.

[21] Appl. No.: 540,297

[22] Filed: Oct. 11, 1983

Related U.S. Application Data

[63] Continuation of Ser. No. 282,449, Jul. 13, 1981, abandoned.

[51] Int. Cl.[3] ..... E21B 47/06

[52] U.S. Cl. ..... 73/151; 73/714

[58] Field of Search ..... 73/151, 714; 166/250, 166/113, 77, 65 R

[56] References Cited

U.S. PATENT DOCUMENTS

| | | | |
|---|---|---|---|
| 2,347,746 | 5/1944 | McWilliams | 166/250 |
| 3,385,358 | 5/1968 | Shell | 166/250 |
| 3,478,584 | 11/1969 | Strubahr et al. | 166/250 |
| 3,835,929 | 9/1974 | Suman | 166/65 R |
| 3,895,527 | 7/1975 | McArthur | 73/151 |
| 3,920,076 | 11/1975 | Laky | 166/77 |
| 4,200,297 | 4/1980 | Tricon | 166/65 R |

FOREIGN PATENT DOCUMENTS

| | | | |
|---|---|---|---|
| 2744829 | 4/1979 | Fed. Rep. of Germany | 166/65 R |

*Primary Examiner*—Jerry W. Myracle

*Attorney, Agent, or Firm*—Browning, Bushman, Zamecki & Anderson

[57] ABSTRACT

A system for providing a fluid communication path between the surface and a downhole location in a borehole includes a capillary tubing which is secured to the outside of a production pipe string and which is run into the borehole on the pipe string. The tubing is sized to accommodate the downhole injection of treating chemicals into the producing fluid stream, primarily for corrosion control. In many instances it is desirable to make downhole pressure measurements in a producing well. A small solid slickline with an attached plunger is pumped down the chemical injection tubing into a chamber at the bottom of the tubing. The slickline substantially restricts the cross-sectional area of the injection tubing to accommodate accurate direct pressure measurements at the remote downhole location.

20 Claims, 2 Drawing Figures

BOREHOLE PRESSURE MEASURING SYSTEM

This application is a continuation of co-pending application Ser. No. 282,449 filed July 13, 1981, now abandoned.

BACKGROUND OF THE INVENTION

1. Field of the Invention

This invention pertains to a method and apparatus for providing a fluid communication path in a wellbore and more particularly to a method and apparatus for permitting the combined usage of an auxiliary tubing on a pipe string to pass fluids between the surface and a downhole location and also accurately transmit fluid pressure changes.

2. Description of the Background

It is often desirable to pass a small diameter tubing, hereinafter referred to as capillary tubing, into a borehole to provide communication from the surrface to the bottom of a borehole or vice versa. For example, it may be useful to communicate pressure data from downhole to the surface by transmitting the fluid pressure through a fluid within a small diameter capillary tubing. Such a system is shown in detail in U.S. Pat. No. 3,895,527.

The capillary tubing system was initially developed for such surface recording of bottomhole pressures. This type of installation is becoming a routine system with many installations in operation. The majority of these systems thus far are in wells of ten thousand feet or less in depth, on land rather than offshore, where holes, while not straight, do not have extreme deviations.

Another use of such capillary tubing that is being developed is to transport chemicals from the surface to the bottom of a wellbore to treat the fluids and/or formation from which such fluids are being produced into the wellbore. This use of the capillary tubing as a chemical transmission system for downhole injection of chemicals is a more recent development.

Ever since the inception of corrosion control of wells by chemicals, the continuous injection of inhibitor into the fluid stream has been recognized as the optimum treating method. In surface lines and process plants, corrosion control by continuous application of filming inhibitors or buffering chemicals is a standard procedure. The advantages gained by applying the continuous injection procedure in oil and gas wells has long been recognized and several procedures and equipment configurations have been field tested. The two methods most widely tested are kill string tubing and the injection of inhibitor packer fluid through a bottomhole valve providing a port between the casing annulus and tubing.

The kill string tubing systems have been the most successful. However, the cost of installation and many operational disadvantages have limited applications of the method. Tubing or pipe size used is generally three-fourth inch to one inch in diameter, and in long strings special high strength joints are required. In addition to the added cost of running the tubing, a special wellhead design is necessary. However, in critical wells, the costs are compounded when considering the operational problems caused by the kill string. The string usually prevents the running of tools and instruments, some of which are mandatory in critical offshore operations. Also, the kill string complicates workover operations and in large volume wells will markedly reduce the producing rates. When inhibiting through a kill string, the bottom will generally be equipped with a valve or flow restricting device. At normal treating rates of a pint to a quart of inhibitor per million cubic feet of gas, the inhibitor in the tubing will be subject to well temperatures and pressures for extended periods. This requires the selection of an inhibitor that will remain stable and neither separate nor polymerize under well conditions. While in special cases the kill string method is still used, its many disadvantages will preclude its general application.

Using an inhibitor mixwed with a packer fluid and displacing through a bottomhole injector valve into the tubing, in theory, overcomes the many problems associated with the kill string method. While there have been successful applications of the bottomhole injector valve system, most installations fail soon after the start of application. Since the inhibitor volumes injected at normal producing rates are quite small, the valve ports must have small diameters to prevent gas from being bypassed to the annulus. The principal cause of failure is plugging of the injection ports. The most frequent source of plugging solids will be fines or drilling fluid additives that remain in the annulus after displacing of the packer fluid and setting of the packer. While in theory the system is good, in practice failures have been so frequent that the system would be considered only as a last resort.

Considering field experience, neither of these two methods have warranted continued research and development. However, corrosion engineers in the industry have continued to recognize the need for a downhole inhibitor transmission system for corrosion control in oil and gas wells. Within the last ten years, with the drilling of deeper, hotter, higher pressure reservoirs, producing at high rates, present gas well corrosion control procedures are often inadequate. The limitations of present methods are apparent in offshore operations in the Gulf of Mexico, where failures from corrosion can result in catastrophic blowouts and costly workovers. When the inadequacies of present methods are considered, the necessity of developing a positive downhole chemical transmission procedure becomes obvious.

The three corrosion inhibiting procedures generally used in gas wells are batch, tubing displacement and squeeze. With each of these methods, the objective is to film the tubing wall with an insulating liquid or semiliquid that adheres tightly to the steel. This breaks the current flow circuit through the water between the anodic and cathodic areas of the steel, stopping the electrochemical reaction. The film must be renewed or reinforced periodically; the treating periods being a function of gas velocity, liquids and solids entrained in the flow stream. For shallower depths (less than ten thousand feet) and lower pressures, temperatures and flow rates, these inhibiting methods, along with suitable inhibitors and appropriate treating periods have given good protection. But today, in deep, hot, high velocity and frequently deviated tubing strings, protection is often inadequate. The major problem is probably velocity of the gas and entrained liquids and solids. The inhibitor film is estimated to have a thickness of two mils. At high velocities, the gas and entrained liquids and solids will rapidly erode this thin film. Another problem in hot wells is the tendency of some inhibitors to polymerize to a brittle, glassy film. Where this film has continuity, it affords corrosion protection but, on solidifying, the inhibitor shrinks, leaving cracks and crevice-type holidays. Also, many of these polymerized films lose their adhereence and are readily chipped from the steel. Attempting to control corrosion by any of these methods would require frequent treating, with intervals of as short as once a week being indicated in some wells.

Even if corrosion control could be assured with any of these three procedures, logistic problems, personnel, and equipment requirements and production loss during treating periods are major disadvantages. This is particularly so in offshore operations where transporting large volumes of inhibitor and diluents along with heavy, large pumps is expensive. Also, where treatments are frequent and gas sales demand is equal to field capacity, scheduling of treatments to assure good corrosion control is difficult.

Over the past several years, it became obvious that for efficient economically sound operations an improved corrosion control method was required. The logical solution was to develop a more effective system to continuously transmit the corrosion control chemical to the bottom of the well, and subsequently enter the tubing string.

With the decision to treat by transmission of inhibitor to the bottom of the hole, there were three methods that could be considered. The kill string and bottomhole valve system, as previously discussed, or the use of a capillary tube installed in the annulus. While the capillary system had never been used for transmission of inhibitors, or in deep, highly deviated holes, it had been successfully used pneumatically for surface recording of bottomhole pressures and hydraulically for injection of single component, low viscosity liquids. Most of the installations had been in straight holes at relatively shallow depths. Subsequent developments have solved many of the problems associated with the system.

Advantages of the present system for downhole injection through a capillary tubing include:

1. The capillary system assures delivery of clean, debris free inhibitor to the downhole injection chamber.
2. Capillary volume is small, minimizing time, and well temperature effects on inhibitor.
3. Inhibitor formulas and injection rates can be quickly changed.
4. Design of capillary system minimized possibility of communication between tubing and casing annulus.
5. Capillary can be used for batching of combination treatments, i.e. corrosion and scale inhibitors, foaming agents, cleaning agents, methanol.

Other advantages of the capillary system include: more efficient production, the reduction of capital investment, safer operation, less manpower requirements and, reduction of chemical costs.

Small diameter capillary tubes have been available for a number of years. However, prior to the mid-1970's, the method of forming the capillary tubing limited the length of sections, so that jointing was required when any significant length of a capillary was used. Successful well applications had been made with reasonably long lengths of the jointed capillaries. But it was obvious that long, continuous lengths of capillary tubing would be required before applications in well bores would be generally accepted.

A new tubing forming method was developed to produce continuous coil lengths of four thousand to ten thousand feet of tubing. The tubing is available in alloys such as 316L stainless steel and 825 Incoloy. The Incoloy tubing was developed specifically for highly corrosive conditions, such as geothermal wells where the stainless tubing was inadequate.

The foregoing background information is set forth in even greater detail in a paper 268 presented to the National Association of Corrosion Engineers, Mar. 3–7, 1980, Chicago, Ill., entitled "Corrosion Protection By Downhole Continuous Inhibitor Transmission Via External Capillary".

When such tubular communication, as described above, is used in a borehole, the small diameter tubular member is typically passed along the outside of tubing and attached thereto as the tubing or pipe string is introduced into the borehole. The pipe string is normally made up of pipe sections which are coupled together with threaded connectors formed integrally on each end of the pipe sections to form a pipe joint. Such pipe joints typically form an upset portion on the pipe string. When small diameter tubing is passed along the pipe string, it must necessarily pass over each pipe joint upset. Tubing protectors are used to protect the tubing from wear, particularly as it passes over each pipe joint upset, and also to support the tubing longitudinally on the pipe string.

In providing a chemical transport system, a tube having a diameter on the order of one-fourth inch to three-eighth inch may be necessary in order to move an acceptable quantity of chemical downhole in a given period of time. This diameter tubing is, however, too large to accurately communicate downhole pressure to the surface as is usually accomplished with 0.094 inch OD/0.054 inch ID tubing. Thus, two tubes have been required, one for chemical transport and one for pressure communication.

It is therefore an object of the present invention to provide a new and improved combined system for transporting chemicals between the surface and downhole in a wellbore and for accurately transmitting fluid pressures.

SUMMARY OF THE INVENTION

With this and other objects in view, the present invention contemplates a borehole fluid production system having a pipe string extending between the surface and a downhole location and passing a tubular member into the borehole on the pipe string. The tubular member is sized to accommodate the transport of treating fluids between the surface and the downhole location. When it is desired to transmit pressure changes between the downhole location and the surface, a slickline is inserted into the tubular member and by means of a plunger attached to the slickline, it is pumped into the tubing member to thereby substantially restrict the cross-sectional area and volume of the tubular member so that accurate pressure changes can be communicated through the tubular member.

DETAILED DESCRIPTION OF A PREFERRED EMBODIMENT

Figure 1:
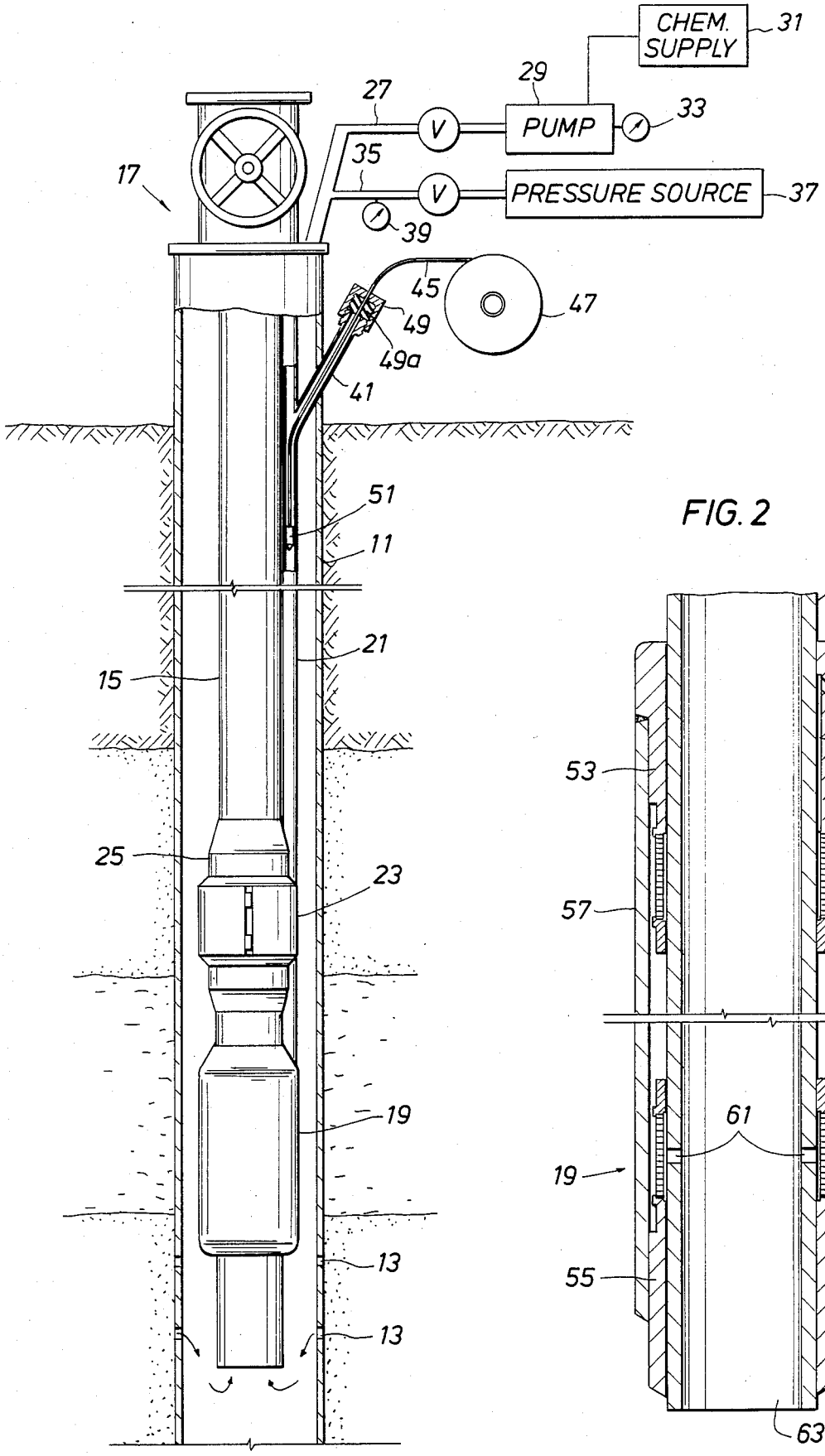
FIG. 1 is a side elevational view of a wellbore illustrating schematically in partial cross section the capillary tubing and slickline assembly of the present invention. The diameter of the slickline assembly is not illustrated to scale.

Referring first to FIG. 1 of the drawings, a wellbore is shown extending from the surface into underground formations. Production equipment for producing fluids from the formation is shown schematically and includes a casing 11 in the wellbore having perforations 13 at its lower end to permit the entry of formation fluids. A tubing or pipe string 15 extends from the wellhead 17 at the surface downwardly within the casing 11 to the lower end thereof. A concentric chamber housing 19 is positioned about the tubing 15 as will be described in greater detail with respect to FIG. 2.

A small diameter tubular member or capillary tube 21 suitable for providing a chemical transport system such as the one-fourth inch to three-eighth inch diameter tubing described herein is shown on the outside of the tubing string 15. A latch type tubing protector 23 is clamped about the tube 21 where it passes over upset connector portions 25 in the tubing string 15. The latch type protector serves to protect the tube 21 against deformation by forceful contact with the casing wall. The protector 23 also serves to support the vertical weight of the tube 21. The lower end of capillary tube 21 extends into the concentric chamber housing 19. The tube 21 extends upwardly along the pipe string 15 to the wellhead 17 where it exits the production apparatus through appropriate seal off devices. The upper end of tube 21 at the wellhead is connected by a first passage 27 to a pump 29 for pumping treating fluids from a chemical supply 31. A pressure gauge 33 provides a means to measure pressure on the tube 21 through the pump 29. A second passage 35 connects the upper end of tube 21 with a pressurized source of gas or other suitable fluid 37 used in making downhole pressure measurements. A pressure gauge 39 provides a means for measuring pressure changes at the surface.

A third passage 41 extends obliquely from the side of tube 21 near its upper end, to the exterior of the wellhead, and provides an openable end portion for introducing a slickline 45 into the tube 21. The slickline is carried on a reel 47 positioned adjacent the wellhead. A suitable packing material 49*a* is provided around the slickline 45 at its upper end within the openable end portion in the passage 41. A cap 49 holds the packing in place about the slickline in the open end of passage 41. When the slickline is not inserted in passage 41, a blind end cap is used to close off the passage 41. A plunger or piston 51 is connected to the end of line 45 to facilitate its being pumped through the tube 21. For purposes of clarity in illustration, the slickline 45 appears to be of a size somewhat smaller than capillary tubing 21. However, in reality, as is inherent from the tubing diameters described herein, the cross-sectional area of slickline 45 is not substantially different from the cross-sectional area of tubing 21. The plunger 51 is constructed of a pliant material which will adapt to variances in the internal diameter of the tube 21 and at the same time be firm enough to develop a sufficient pressure differential to pull the line 45 through the tubing 21 until the plunger 51 exits the lower end of tube 21 into concentric chamber housing 19.

Figure 2:
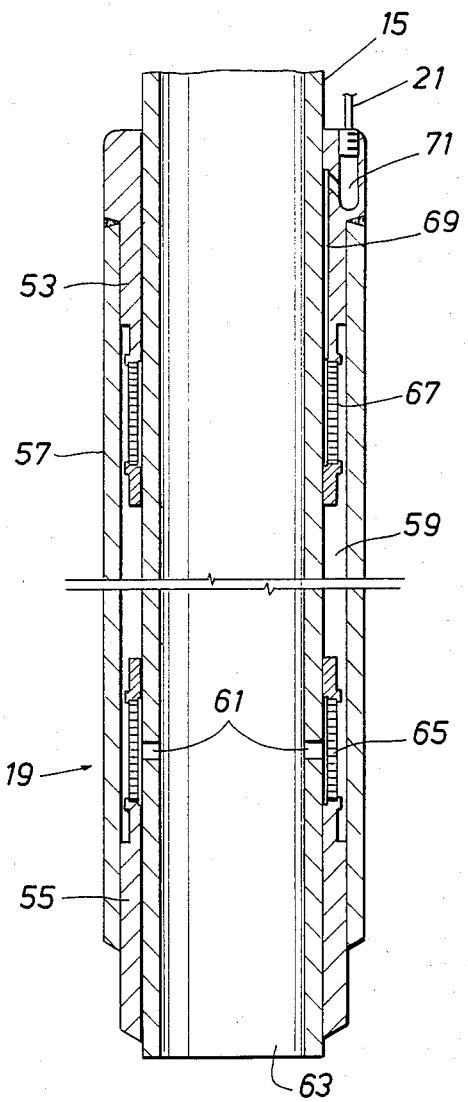
FIG. 2 is a cross-sectional view of the lower concentric chamber housing illustrating the termination of the capillary tubing in the lower annular chamber.

Referring now to FIG. 2 of the drawings, the concentric chamber 19 is shown having upper and lower inner wall portions 53 and 55 respectively which fit about the tubing string 15 and which are connected as by welding or the like to an outer wall portion 57. The inner wall portions 53 and 55 provide spacing between tubing 15 and the outer wall portion 57 to define an annular chamber 59. The inner wall portions are sealed against the pipe string 15 and likewise against the outer wall portion 57 as by welding or the like to render the chamber 59 as a sealed chamber. Openings are provided into the sealed chamber 59 by means of ports 61 which are formed through the wall of pipe string 15. Thus, production fluids entering the lower end 63 of pipe string 15 are communicated with the chamber 59 by means of ports 61.

A screen 65 in the concentric chamber covers the ports 61 to prevent foreign materials from clogging the system. Another screen 67 covers the lower end of a passage 69 connecting the chamber 59 with an auxiliary chamber 71 at the upper end of housing 19. Chamber 71 connects with the tubing 21 and provides a space into which the plunger 51 may egress from the tube 21 when the slickline 45 has passed entirely through the tube 21.

Installation of the above-described equipment requires a spool reel 47 with a pressure swivel joint to hold the capillary tubing 21. The spool reel has a friction brake to hold tension on the capillary tube as it is being inserted in the wellbore. The concentric chamber housing 19 is placed in the hole at the surface on the bottom end of the pipe string 15 and the capillary tube is connected to the housing 19. The capillary tube is pressurized all the time it is being run into the wellbore to immediately determine at the surface if damage occurs to the tubing 21 as it is being run into the well. The production string 15 is then run into the hole in a normal manner, securing the tube 21 to the pipe string 15 at every tool joint with a tubing protector 23.

The system is kept charged with an inert gas while going in the hole to keep wellbore fluids from getting inside the capillary tube, as this would result in a false reading of pressure on the surface, indicating that a problem exists with the system downhole.

The capillary tube exits the wellhead through a surface pack off, where it is connected to the surface equipment including the chemical injection system, pressure measuring system, and miscellaneous valves, pumps, and filters which comprise such surface equipment.

A major requirement for assuring trouble free operation of a capillary tubing installation is removal of all solid contaminants or debris that could plug the line. Filters are installed through the system to cover this requirement.

Heretofore for pressure measurements, a separate capillary tubing having an OD of 0.094 inch and an ID of 0.054 inch has been required. In order to provide accurate pressure measurements, it is necessary to use a concentric chamber having a volume at least equal to the capillary tubing and preferably four times as great. This is to insure that pressure measurements are made with a gas filling the capillary tubing and extending into the chamber 59 where it interfaces with production fluids. The chamber 59 permits expansion and compression of the pressure-transmitting gas column without entry of well fluids into the capillary tube. The size of the chamber 59 is thus dependent on the anticipated pressure range to be encountered and the diameter of the tube 21. Thus, care must be taken that the ratio of chamber 59 volume and the capillary tube is sufficiently large so that with pressure increases, well fluids can rise in the chamber without entering the tube 21. Well fluids in the tube 21 are subject to viscous drag and cause rapidly changing heads with small changes in pressure, thus leading to inaccuracies in pressure measurement.

Where using the capillary tubing of 0.054 inch ID to measure pressure, the cross-sectional area of such tubing is sometimes inadequate to permit sufficient chemical volumes to be injected into the production string to accomplish satisfactory chemical treatment of the well. However, if larger diameter capillary tube is used, such as the one-fourth to three-eighth inch diameter chemical transport tubing described herein, the chamber 59 volume must be increased to maintain the ratio described above. This increased size requirement of chamber 59 thus becomes a problem.

The provisions of the present system for introducing a slickline into a capillary tube suitable for providing a chemical transport system in order to substantially reduce its cross-sectional area permits the tube to also be used in a pressure measuring system with a more manageable size of downhole chamber. The substantial nature of the restriction of cross-sectional area and volume of the present invention is illustrated by reference to the diameters of tubing for chemical transport and pressure measurement which have been described herein. In the system described above, slickline 45 inherently must restrict the volume of tubing 21 having a diameter of one-fourth to three-eighth inch by more than ninety-five percent to produce a tubing useful for pressure measurement and having a cross-sectional area and volume about equal to that of the described 0.054 inch ID pressure measuring capillary.

Under certain circumstances, it may be desirable, in the system described above, to provide an electrical communication path between the surface and the downhole location. In such an event, the slickline is provided with one or more electrical conductors. The plunger 51 is then provided with electrical contact means. When the plunger egresses from the lower end of tube 21 into chamber 71, means in the chamber 71 are provided for latchingly receiving the plunger and making electrical contact with the conductors. The tubing 21 itself may serve as one electrical path in the system. Thus, downhole electrical apparatus may be linked with the surface through this same system, providing still another use of the combined system.

While particular embodiments of the present invention have been shown and described, it is apparent that changes and modifications may be made without departing from this invention in its broad aspects and therefore the aim in the appended claims is to cover all such changes and modifications as fall within the true spirit and scope of this invention.

What is claimed is:

1. In a borehole fluid production system including a pipe string extending from the surface to a downhole location, means suitable for both injecting chemicals into the system downhole and for making downhole pressure measurements, comprising:

a tubular member attachable to the pipe string and extending from the surface to the downhole location, said tubular member sized to accommodate the injection of treating materials into the production system at said downhole location; and means insertable into the tubular member for substantially restricting the cross-sectional area and total volume of the bore of the tubular member to thereby facilitate the measurement of downhole pressure.

2. The apparatus of claim 1 further comprising chamber means at the bottom end of and in fluid communication with said tubular member.

3. The apparatus of claim 2 wherein the volume of said chamber means is at least equal to the restricted volume of said tubular member.

4. The apparatus of claim 2 further comprising means for pressurizing said tubular member and at least a portion of said chamber means with a fluid.

5. The apparatus of claim 4 further comprising means in fluid communication with said tubular member for detecting changes in the pressure of said fluid within said tubular member.

6. The apparatus of claim 4 wherein said pressurizing fluid is a gas.

7. The apparatus of claim 1 further comprising means on said insertable means for accommodating pumping of said insertable means through said tubular member.

8. The apparatus of claim 7 wherein said insertable means is a slickline and said pumping accommodating means is an enlarged diameter plunger portion on the end of said slickline, which plunger portion is sized to movably fit within said tubular member, so that when fluid pressure is applied to said plunger portion said plunger portion and attached slickline are passed through said tubular member.

9. The apparatus of claim 8 wherein said slickline is a solid member having at least one electrical conductor therein.

10. A method for measuring downhole pressure in a borehole production system having a production pipe string extending from the surface to underground formations, comprising the steps of:

attaching a tubing of sufficient internal diameter to the production pipe string to accommodate the introduction of treating chemicals through said tubing into the borehole production system at a downhole location;

passing the production pipe string and attached tubing into the borehole;

passing a restricting member into the tubing to substantially restrict the cross-sectional area and volume of the tubing to the extent that accurate pressure measurements of downhole fluids can be made at the surface; and monitoring changes in pressure of fluid in the tubing at the surface.

11. The method of claim 10 wherein the step of passing said restricting member into said tubing comprises applying fluid pressure behind a plunger means attached to said restricting member to facilitate passing of said restricting member through said tubing.

12. The method of claim 11 wherein said restricting member includes at least one electrical conductor and further comprising the step of passing an electrical signal through said conductor between the surface and a downhole location.

13. The method of claim 10 further comprising the step of pressurizing the restricted volume of said tubing with a gas prior to monitoring the changes in pressure.

14. The method of claim 10 further adapted for introducing treating chemicals into the borehole, comprising the steps of:

removing said restricting member from its restricting location in said tubing; and passing useful quantities of treating chemicals through said tubing from the surface to said downhole location.

15. An apparatus for use in a downhole fluid production system including a pipe string extending to a downhole location and for making pressure measurements at said downhole location, comprising:

a tubular member positionable on said pipe string and extending from the surface to said downhole location, said tubular member having a cross-sectional area and volume substantially greater than that appropriate for accurately communicating downhole pressure changes from said downhole location to the surface; and means for substantially restricting the cross-sectional area and volume of said tubular member so that downhole pressure can be accurately communicated to the surface through said tubular member.

16. The apparatus of claim 15 further comprising means on said restricting means for accommodating the pumping of said restricting means through said tubular member.

17. The apparatus of claim 16 further comprising downhole chamber means in said tubular member to receive the egress of said pumping accommodating means from said tubular member and thereby sufficiently open said tubular member to permit fluid pressure communication from said downhole location to the surface.

18. The apparatus of claim 17 further comprising pressure measuring means in fluid communication with said tubular member at the surface.

19. The apparatus of claim 15 wherein said tubular member is sized to accommodate the passage of treating chemicals in useful quantities from the surface to the downhole location.

20. The apparatus of claim 15 further comprising electrical conductor means incorporated in said restricting means to provide an electrical path between the surface and downhole.

* * * * *